US007845972B1

(12) United States Patent
Miller

(10) Patent No.: US 7,845,972 B1
(45) Date of Patent: Dec. 7, 2010

(54) CERAMIC LAMPHOLDER WITH A THERMAL SWITCH IN A RADIATOR THERMALLY BONDED TO ITS HOUSING

(76) Inventor: Jack V. Miller, NoUVIR Lighting Corp., 20915 Sussex Hwy., Seaford, DE (US) 19973

( * ) Notice: Subject to any disclaimer, the term of this patent is extended or adjusted under 35 U.S.C. 154(b) by 0 days.

(21) Appl. No.: 12/794,063

(22) Filed: Jun. 4, 2010

(51) Int. Cl.
*H01R 13/00* (2006.01)

(52) U.S. Cl. ..... 439/487

(58) Field of Classification Search ..... 439/487; 362/294, 551; 200/51.06
See application file for complete search history.

(56) References Cited

U.S. PATENT DOCUMENTS 2,505,518 A * 4/1950 Benander ..... 200/51.06
4,682,276 A * 7/1987 Miller ..... 362/294
5,263,874 A * 11/1993 Miller ..... 439/487
5,514,006 A * 5/1996 Getselis et al. ..... 439/417
7,223,002 B2 * 5/2007 Miller et al. ..... 362/551

* cited by examiner

*Primary Examiner*—Chandrika Prasad

(57) ABSTRACT

The present invention provides a high-temperature ceramic lampholder with an integral thermal switch for use in recessed or portable recessed lighting fixtures for general lighting in residential, institutional and commercial buildings. Lampholders according to the invention extend lamp life by reducing lamp base temperatures; improve fixture safety by lowering the heat on wire insulation; and lower fixture toxicity and enhance fixture reliability by eliminating solder joints with spade connectors.

6 Claims, 1 Drawing Sheet

SECTION A-A

SECTION B-B

LOW
MED
COM

CERAMIC LAMPHOLDER WITH A THERMAL SWITCH IN A RADIATOR THERMALLY BONDED TO ITS HOUSING

FIELD OF THE INVENTION

The present invention relates to the field of lampholders and more specifically to screw-base ceramic lampholders used in recessed lighting fixtures for general lighting in residential, institutional and commercial buildings.

BACKGROUND OF THE INVENTION

Over recent years here has been an ever-increasing need for energy conservation in general lighting for residential, institutional and commercial buildings. One of the means for saving lighting energy has been the replacement of inefficient A-type incandescent lamps with tungsten/halogen lamps having about twice the L/P (lumens per Watt) or with CFL (Compact Fluorescent Lamps) having three times more lumens per Watt than A-type incandescent lamps.

In order to use tungsten/halogen lamps or CFL lamps in light fixtures that are recessed above a ceiling, UL (Underwriter's Laboratories) and various building codes require high-temperature ceramic lampholders, over 90% of which are for medium screw-base lamps. Then, in order to obtain a safety listing under UL standard1598 for a recessed light fixture, the fixture must have a thermal cut-off switch as well as the high-temperature ceramic lampholder. The purpose of the thermal switch is to prevent the lamp heat from burning the insulation off the wiring inside the fixture, which would create a possible electric shock hazard.

DISCUSSION OF THE PRIOR ART

Prior to the present invention, 3-way lamps were used only in unenclosed portable lamps, such as table lamps and floor lamps with the light sources cooled by ambient air. Thus, prior to the present invention, all 3-way lampholders were made of polymeric materials, such as Bakelite®, or had a brass outer housing with conductors and the screw shell insulated with plastic-impregnated paper.

At the time the present invention was made, the applicant contacted the major lampholder manufacturers, G. E., Osram-Sylvania and Leviton, plus distributors and retail outlets; and found there were (and still are at the date of this filing) no 3-way ceramic lampholders available from any manufacturer. This prohibits the use of 3-way lamps that permit changing lamp output (and energy consumption) to match the usage and weather conditions of a building.

Further, presently known prior-art recessed light fixtures, even those using single-circuit ceramic lampholders, are required to have a thermal switch, which is attached somewhere on the metal fixture housing. Therefore the wire insulation could be damaged before the thermal switch reached a typical tripping temperature of 90° to 100° centigrade. Thus the thermal switches of prior-art recessed fixtures do not serve the basic function of protecting the wiring from damage.

Since there were no available commercial prior-art sources for 3-way ceramic lamholders, or lampholders having integral thermal switches, or lampholders having integral cooling fins, the lampholder of the present invention was designed, developed, prototyped and tooled by the applicant, to be available only by sale or licensing by the applicant.

PURPOSES OF THE PRESENT INVENTION

The first purpose purpose of the present invention is to save electrical energy by providing a ceramic lampholder that will permit the use of 3-way lamps in recessed light fixtures. With currently-available power (or with CFLs equivalent power) of 30-60-100 Watts, the 30 Watt level (about 500 lumens) would be more than adequate for lighting open areas, aisles and corridors; the 60 Watt level (about 900 lumens) is adequate for computer or other electronic display tasks, and the 100 Watt level (about 1950 lumens) is appropriate for detailed visual tasks such as small assembly work, reading and hand writing. Exceeding the appropriate light levels will not only waste energy, but excessive brightness can actually cause glare that reduces vision.

The second purpose of the present invention is to increase light fixture safety by providing a ceramic lampholder for 3-way lamps or single-circuit lamps, in which the lampholder includes an integral thermal switch that will disconnect if the fixture overheats due to improper ventilation. or the lamp exceeds the maximum rated fixture wattage.

The third purpose of the present invention is to increase lamp life by providing a ceramic lampholder that reduces the lamp electrode seal temperature and hence the differential glass-to-metal seal temperatures that most often cause lamp failure.

DETAILED DESCRIPTION OF THE DRAWINGS

Figures 1, 2, 3, 4:
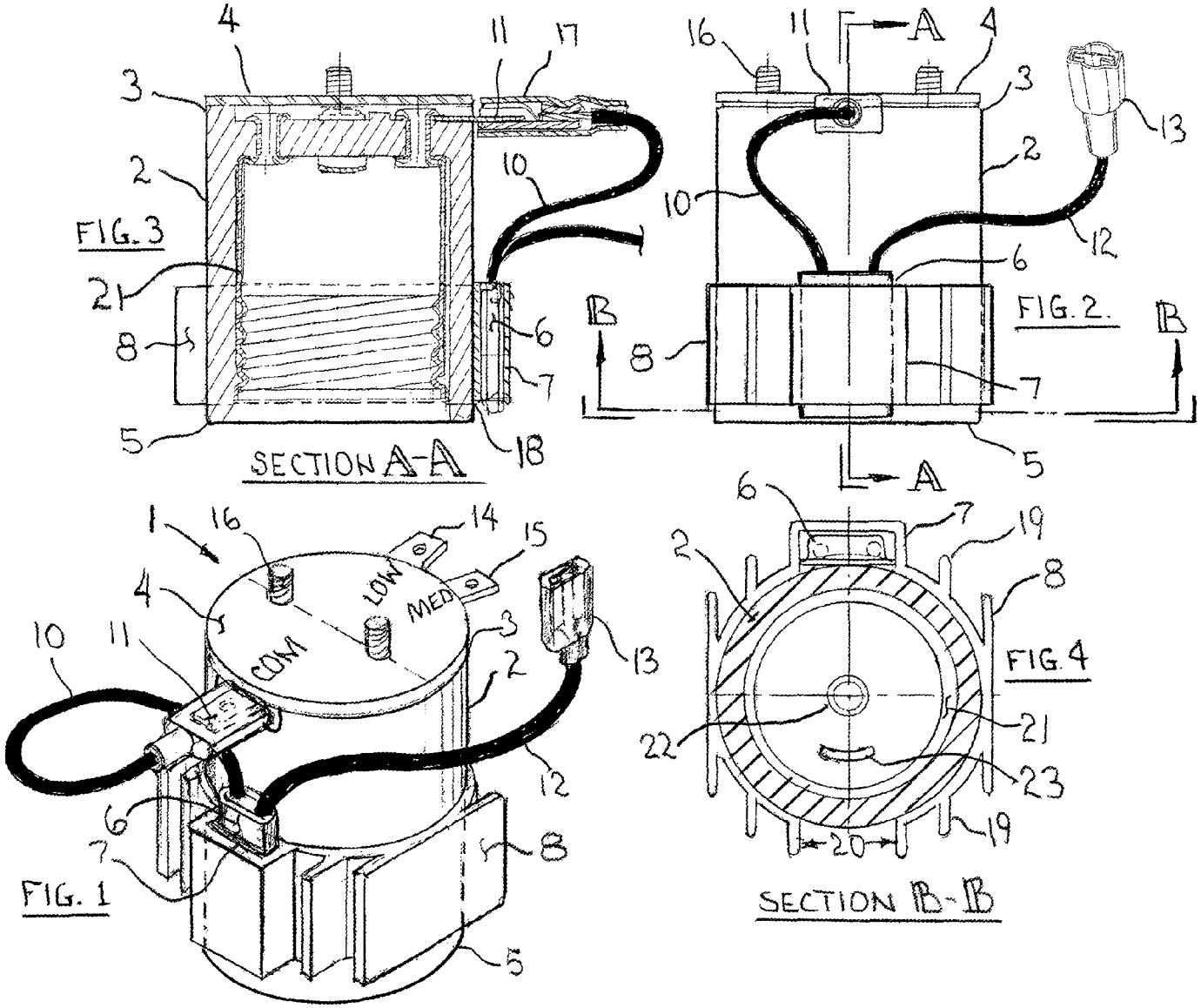
FIG. 1 is a perspective view of a 3-way configuration option of the invention.
FIG. 2 is a side elevation view of the configuration of FIG. 1.
FIG. 3 is cross-sectional view taken along centerline line A-A of FIG. 2.
FIG. 4 is cross-sectional view of FIG. 2 taken through section line B-B of the lampholder at the open lamp-receiving distal end.

In FIG. 1 a perspective view of the 3-way optional configuration lampholder (1) of the present invention is shown having a ceramic housing (2) terminating in a proximal end (3) having an electrical insulator (4), and a distal lamp-receiving end (5). A thermal switch (6) is retained in a channel (7) of a radiator (8). Both the thermal switch (6) and the radiator (8) are thermally bonded to the exterior diameter (4) of the ceramic housing (2). Thermal switch (6) has a first power lead (10) connected to a common (screw-shell, not shown in this view) connection (11), and a second power lead (12) connected to a female spade connector (13) for connection to external power. One or more mounting screws (16) extend in the proximal direction for mounting in a light fixture (not shown). External power (not shown) is connected to the LOW operating mode male spade connector (14) and to the MEDIUM operating mode male spade connector (15), with both connected for a HIGH operating mode (for a 3-way lamp, not shown), typical of prior-art lampholders.

In the side elevation view of FIG. 2 ceramic housing (2) is shown terminating in a proximal end (3) having an electrical insulator (4), and a distal lamp-receiving end (5). Thermal switch (6) is retained in a channel (7) of a radiator (8). Both the thermal switch (6) and the radiator (8) are thermally bonded to the exterior diameter (4) of the ceramic housing (2). Thermal switch (6) first power lead (10) is connected to a common (screw-shell, not shown in this view) connection (11), and a second power lead (12) connected to a female spade connector (13) for connection to external power. Mounting screws (16) extend in the proximal direction for mounting in a light fixture (not shown).

In the cross-sectional view A-A of FIG. 3 ceramic housing (2) is shown terminating in a proximal end (3) having an electrical insulator (4), and a distal lamp-receiving end (5). Thermal switch (6) is retained in a channel (7) of a radiator (8). Both the thermal switch (6) and the radiator (8) are thermally bonded with a heat-conducting adhesive (18) to the exterior diameter of the ceramic housing (2). Thermal switch (6) first power lead (10) is connected to a common connection (11) of a screw-shell (21) with an electrical connector (17) and a second power lead (12) is connected to external power (not shown). One or more mounting screws (16) extend in the proximal direction for mounting in a light fixture (not shown).

In FIG. 4 the transverse cross-sectional view of FIG. 2 is shown, taken through the lampholder ceramic housing (2) at the lamp-receiving distal end (5). Radiator (8) is shown having channel (7) retaining thermal switch (6) in thermal contact with ceramic housing (2). Radiator (8) also has a number of cooling fins (19) and an open gap (20) that permits it to conform to the size and shape of ceramic housing (2). Screw shell (21) is retained in ceramic housing (2), along with the center lamp electrode (22) and an intermediate 3-way contact (23). External power (not shown in this view) is connected to the LOW male spade connector (14 in FIG. 1) which is connected to the center lamp electrode (22), and with the intermediate contact (23) optionally connected to the MEDIUM male spade connector (15 in FIG. 1) for 3-way operation; and with both contacts (22, 23) energized for a HIGH operating mode (for a 3-way lamp, not shown. Thus the lampholder (1) of the present invention will operate either a single-circuit lamp or a 3-way lamp, which is typical of most prior-art lampholders.

SUMMARY OF THE INVENTION

The first above-stated purpose of the present invention is achieved by providing a ceramic lampholder that will save electrical power by permitting the use of 3-way lamps in recessed light fixtures and using only the lamp Watts needed for each specific function and task.

The second purpose of the present invention is achieved by providing a ceramic lampholder that will improve light fixture safety with an integral thermal switch that will disconnect if the fixture overheats due to improper ventilation or the a lamp that exceeds the maximum rated fixture wattage.

The third purpose of the present invention is achieved by providing a ceramic lampholder that will increase lamp life by reducing the lamp electrode seal temperatures that most often cause lamp failure.

The fourth purpose of the present invention is achieved by providing a ceramic lampholder that will decrease assembly costs and reduce fixture toxicity by eliminating all solder connections.

The invention claimed is:

1. A lampholder (1) including:

a generally cylindrical ceramic housing (2) terminating in a closed proximal end (3) having an electrical insulator (4) thereon, and an open distal lamp-receiving end (5);

a thermal switch (6) retained in a channel (7) of a radiator (8) thermally bonded to the exterior (4) of a ceramic housing (2);

a first power lead (10) of said thermal switch is connected to a screw-shell (21) within ceramic housing (2) and a second power lead (12) extending from said thermal switch for connection to a remote source of electrical power;

a center lamp contact (22) supported in the closed proximal end (3) of said ceramic housing (2) and connected to a first external connector (14) for connection to external power; and an optional intermediate lamp contact (23) also supported in the closed proximal end (3) of said ceramic housing (2) and connected to a second external connector (15) for connection to external power.

2. A lampholder (1) according to claim 1 in which the screw shell (21) is a common electrical contact, the first external connector (14) completes the circuit to a single-circuit lamp or optionally completes the circuit to the LOW-MODE contact of a 3-way lamp, the second external connector (15) optionally completes the circuit to the MEDIUM-MODE of a 3-way lamp, and energizing both external connectors (14,15) completes the circuit to the HIGH-MODE of a 3-way lamp.

3. A lampholder (1) according to claim 1 in which the radiator (8) is thermally bonded to the exterior (4) of a ceramic housing (2) and has a number of heat-radiating fins made of a thermally conductive, highly-emissive material, such as black anodize aluminum.

4. A lampholder (1) according to claim 1 in which the radiator (8) is thermally bonded to the exterior (4) of a ceramic housing (2), and has a number of heat-radiating fins made of a thermally conductive, highly-emissive material, such as black anodize aluminum, said fins being oriented in parallel planes.

5. A lampholder (1) according to claim 1 in which the radiator (8) is generally C-shaped, having gap (20) therein, and having a free inside diameter smaller than the outside diameter of the ceramic housing (2), thereby having a frictional fit onto said ceramic housing (2).

6. A lampholder (1) according to claim 1 in which the radiator (8) is generally C-shaped, having gap (20) therein, and having a free inside diameter smaller than the outside diameter of ceramic housing (2), thereby having a frictional fit onto said ceramic housing (2) and being bonded thereon with a heat-conducting adhesive, such as aluminum-filled epoxy or silicone rubber.

* * * * *